US009441816B2

(12) United States Patent
Van Gompel et al.

(10) Patent No.: US 9,441,816 B2
(45) Date of Patent: Sep. 13, 2016

(54) LIGHTING ARRANGEMENT HAVING A RESILIENT ELEMENT

(71) Applicant: KONINKLIJKE PHILIPS N.V., Eindhoven (NL)

(72) Inventors: Waltherus Emericus Johannes Van Gompel, Eersel (NL); Wido Van Duijneveldt, Eersel (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/772,942

(22) PCT Filed: Oct. 20, 2014

(86) PCT No.: PCT/EP2014/072425
§ 371 (c)(1),
(2) Date: Sep. 4, 2015

(87) PCT Pub. No.: WO2015/062889
PCT Pub. Date: May 7, 2015

(65) Prior Publication Data

US 2016/0223169 A1 Aug. 4, 2016

(30) Foreign Application Priority Data

Oct. 28, 2013 (EP) ..... 13190484

(51) Int. Cl.

| | |
|---|---|
| ***F21V 19/00*** | (2006.01) |
| ***F21K 99/00*** | (2016.01) |
| ***F21V 29/70*** | (2015.01) |
| *F21Y 101/02* | (2006.01) |
| *F21Y 103/00* | (2016.01) |

(52) U.S. Cl.
CPC ..... *F21V 19/004* (2013.01); *F21K 9/17* (2013.01); *F21V 29/70* (2015.01); *F21Y 2101/02* (2013.01); *F21Y 2103/003* (2013.01)

(58) Field of Classification Search
CPC ..... F21V 19/004; F21V 29/70; F21K 9/17; F21Y 2101/02; F21Y 2103/003
See application file for complete search history.

(56) References Cited

U.S. PATENT DOCUMENTS

| | | | | |
|---|---|---|---|---|
| 6,361,186 | B1 | 3/2002 | Slayden | |
| 6,592,238 | B2 * | 7/2003 | Cleaver | F21S 4/26 362/219 |
| 2012/0182731 | A1 | 7/2012 | Kretschmann et al. | |

FOREIGN PATENT DOCUMENTS

| | | | |
|---|---|---|---|
| CA | 2751759 | A1 | 3/2013 |
| DE | 102010033298 | A1 | 2/2012 |
| DE | 202012102874 | U1 | 4/2013 |

* cited by examiner

*Primary Examiner* — Thomas M Sember

(57) ABSTRACT

A lighting arrangement (1) is disclosed. The lighting arrangement (1) has a circuit board (2), a support (3) for supporting the circuit board (2) and at least one light source (4) mounted on the circuit board (2). The lighting arrangement also has at least one abutment (6) which is fixed relative to the support (3) and at least one resilient element (5) which is sandwiched between the at least one abutment (6) and the circuit board (2), whereby the resilient element (5) presses against the circuit board (2).

11 Claims, 3 Drawing Sheets

LIGHTING ARRANGEMENT HAVING A RESILIENT ELEMENT

CROSS-REFERENCE TO PRIOR APPLICATIONS

This application is the U.S. National Phase application under 35 U.S.C. §371 of International Application No. PCT/EP2014/072425, filed on Oct. 20, 2014, which claims the benefit of European Patent Application No. 13190484.9, filed on Oct. 28, 2013. These applications are hereby incorporated by reference herein.

FIELD OF THE INVENTION

The present disclosure relates to lighting arrangements, such as tube lighting systems.

BACKGROUND OF THE INVENTION

Many different types of lighting arrangements are known in the art and used for a variety of purposes. Typical applications include illumination of interior spaces, architectural lighting and automotive lighting.

A common type of lighting arrangements is tube lighting systems having light-emitting diodes (LEDs) mounted on a printed circuit board (PCB) inside a straight tubular housing. Various mechanisms for maintaining the PCB in position inside the tubular housing are used. An example of such a mechanism is two opposing slots, provided on the inside of the tubular housing, into which the PCB is inserted. The slots are usually designed to provide a small clearance space for facilitating the insertion of the PCB. This mechanism is typically found in tube lighting systems having a one-piece tubular housing. In some tube lighting systems, fasteners attached to the PCB, such as nails, screws and tape, are used for keeping it in place. This mechanism is typically found in tube lighting systems the tubular housing of which is formed by an upper part attached to a lower part.

As even a small displacement of the PCB, and thus the LEDs, may impact the light distribution of the lighting arrangement negatively, it is desirable that the PCB be maintained firmly in position. It is possible to improve existing lighting arrangements with respect to how the PCB is prevented from being displaced so that the performance of the lighting arrangement is reduced.

U.S. Pat. No. 6,361,186 discloses a tubular lighting device with an array of LEDs on a PCB. The PCB is mounted in a housing and positioned by a spring clip. Said device is further provided with a tube for emitting the light, which tube is connected to the housing.

SUMMARY OF THE INVENTION

The objective is to provide an improved or alternative lighting arrangement. An aspect of particular interest is the mechanism by which the PCB is prevented from being displaced so that the performance of the lighting arrangement is reduced, for example in regard to the light distribution.

The invention is defined by the independent claim. Embodiments are set forth in the dependent claims, the description and the drawings.

According to a first aspect, a lighting arrangement is provided. The lighting arrangement comprises a circuit board, a support for supporting the circuit board and at least one light source mounted on the circuit board. The lighting arrangement also has at least one abutment which is fixed relative to the support and at least one resilient element which is sandwiched between the at least one abutment and the circuit board.

By this construction, the circuit board is pressed against the support by the resilient element, something which can help maintaining the circuit board firmly in position. This, in turn, can reduce the risk of the circuit board, and hence also the light sources, moving, or displacing, in such a way that the distribution of the light from the lighting arrangement changes undesirably. Moreover, this construction can help reduce noise resulting from movement of the circuit board, something which may be particularly important in applications where the lighting arrangement is frequently in motion. Note also that the resilient element as described above can reduce the risk of damaging forces and stresses being imparted on the circuit board, such as those that may result from nails, screws, tape and other kinds of fasteners being attached to the circuit board.

The construction above can for example help prevent displacement of the circuit board of a lighting arrangement having two slots into which the circuit board is introduced and which are designed with a clearance space for facilitating insertion of the circuit board.

The lighting arrangement can have a cover for transmitting light emitted by the at least one light source. The cover can comprise at least one optical element for shaping the light transmitted by the cover. Preventing displacement of the light sources can be particularly important when the lighting arrangement comprises optical elements as the efficient functioning of the optical elements is typically highly dependent on the position of the light sources.

The lighting arrangement can have a support structure for supporting the cover in a separating plane. By "separating plane" is intended a plane defined by the contact points between the supporting structure and the cover. The light sources may be arranged in this separating plane, but this is not necessary. The support can be provided on the support structure, and the at least one abutment can be arranged on the support structure or the cover.

The lighting arrangement can have a carrier supported by the support. The circuit board can be arranged on the carrier. Using a carrier can be a convenient way of orienting the circuit board in a specific direction, for example so that the circuit board has a planar extension substantially perpendicular to the separating plane. Alternatively, the circuit board can have a planar extension substantially coplanar with the separating plane.

The carrier can be a heat sink in thermal contact with the circuit board. The transfer of heat away from the circuit board can be improved by the resilient element pressing the circuit board against the heat sink on which the circuit board is arranged.

The lighting arrangement can have at least one light source mounted on each of two opposing sides of the circuit board. Arranging the light sources to emit light from two sides of the circuit board can be advantageous in some applications.

The carrier can have a reflective layer for reflecting light emitted by the light sources and two recesses facing the reflective layer so that the reflective layer can be received by the two recesses when the resilient element presses against the circuit board. A reflective layer may increase the illumination efficiency of the lighting arrangement. Preventing displacement of the light sources can be particularly important when the lighting arrangement comprises a reflective layer as the properties of the light beam generated by the lighting arrangement can be highly dependent on the position of the light sources relative to the reflective layer. Furthermore, it is often desirable to arrange the light sources as close as possible to the reflective layer, because this may allow for the provision of a lighting arrangement generating a narrow beam of light. However, arranging the light sources very close to the reflective layer may increase the risk of the light sources coming into contact with the reflective layer and, hence, the risk of damaging the light sources. The provision of recesses as described above can reduce the risk of damage to the light sources.

The lighting arrangement can comprise an elongated array of light sources. The cover and support structure can be integrated to form an elongated tube adapted to receive the circuit board by insertion. The elongated tube can be formed by the cover and the support structure being attached together. The cover and the support structure can be formed in one piece which forms the elongated tube. Using a resilient element as described above can be particularly advantageous in tube lighting arrangements having a one-piece elongated tube because it can be difficult to use fasteners, such as nails, screws and tape, to secure the circuit board in such lighting arrangements.

The at least one resilient element can comprise an attachment portion for attachment to the circuit board, an abutment portion adapted to slide against a surface and a resilient portion which resiliently connects the attachment portion to the abutment portion. Such a resilient element can facilitate insertion of the circuit board into an elongated tube by helping to guide the circuit board in place and providing a low-friction contact point between the circuit board and the elongated tube. Moreover, such resilient elements can help reducing damaging stresses and forces on the internal components of the lighting arrangement, such as the light sources and the circuit board, in the event that the lighting arrangement is slightly bent, something which easily can happen with elongated lighting arrangements.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

The figures are provided to illustrate the general structures of embodiments of the present invention. As illustrated in the figures, the sizes of certain features can be exaggerated for illustrative purposes. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
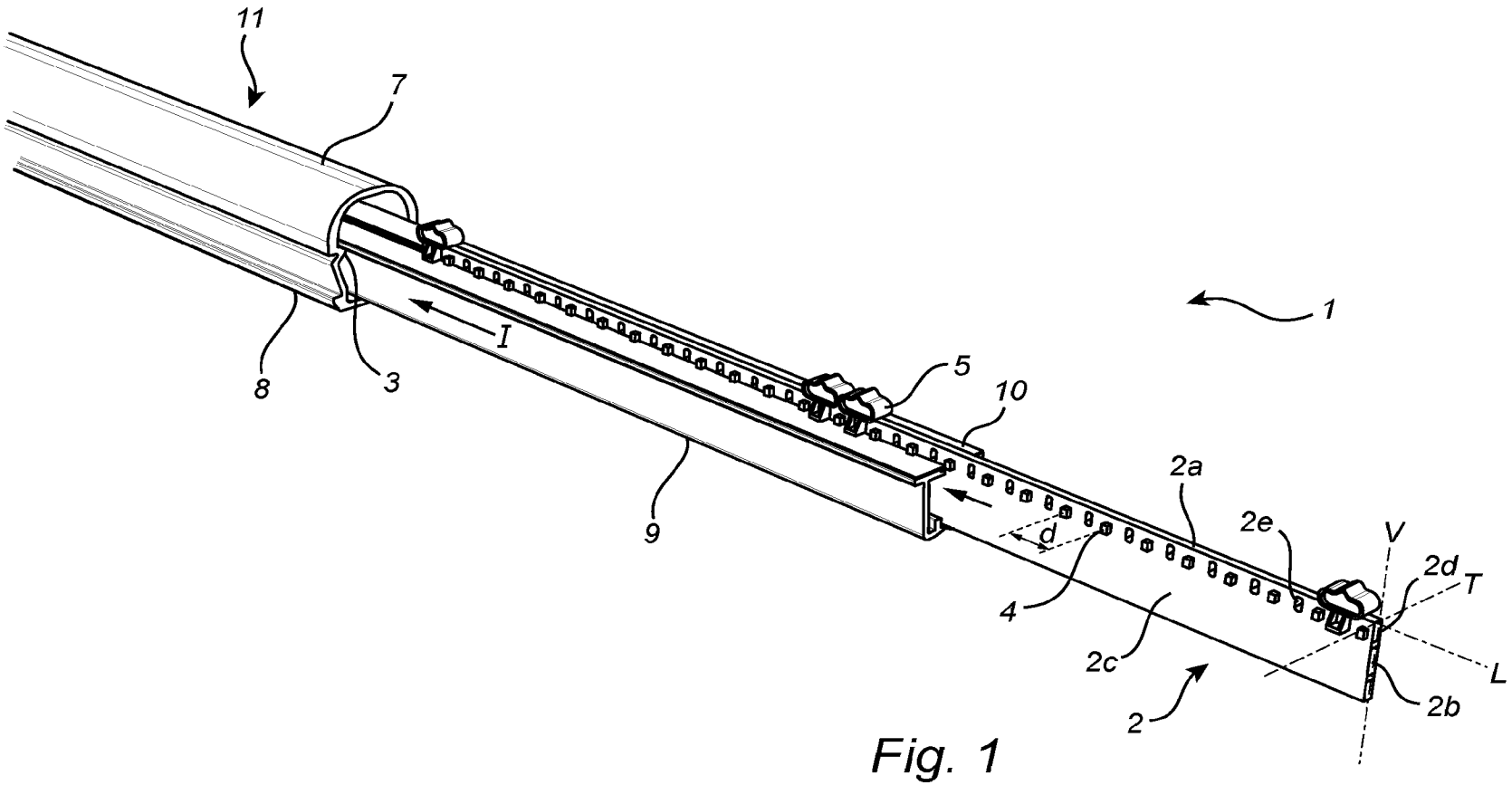
FIG. 1 is a schematic perspective view of a partially assembled lighting arrangement.
Figure 2:
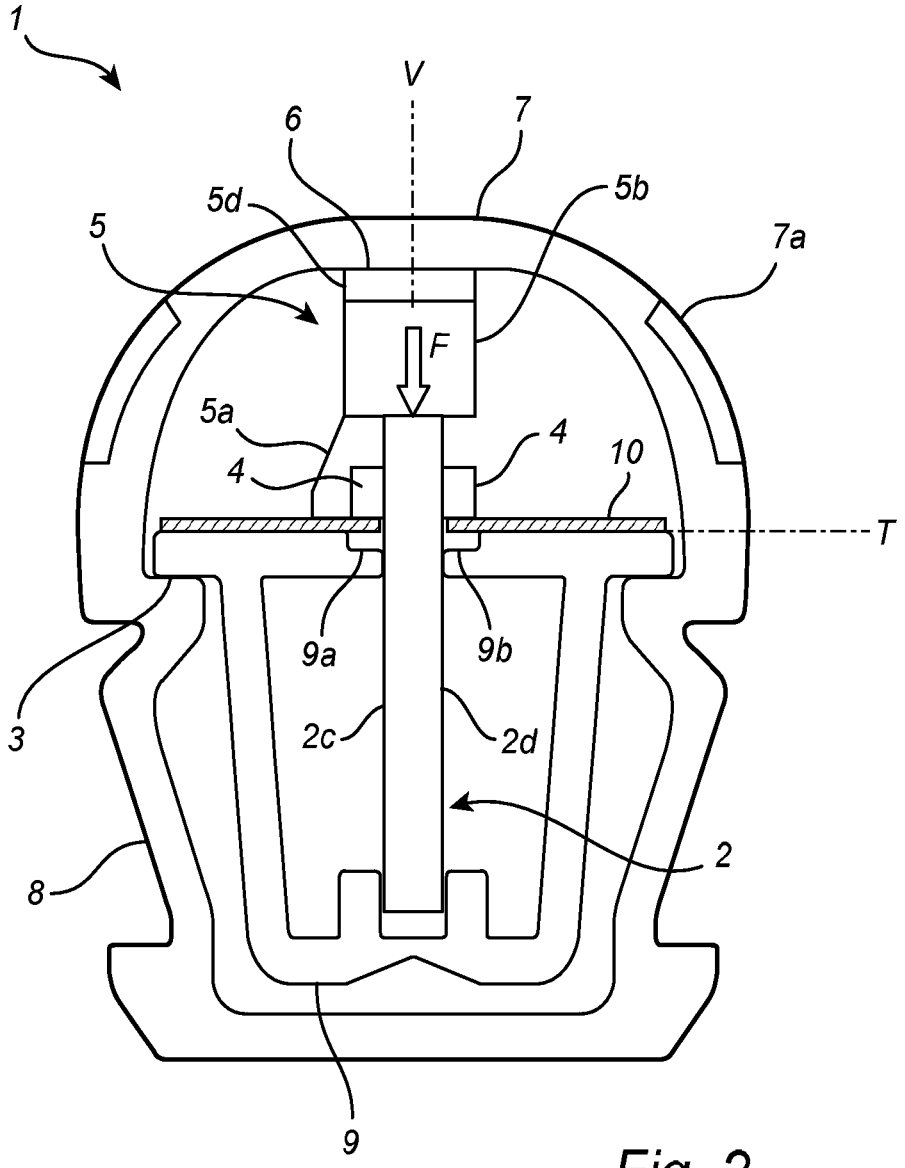
FIG. 2 is a schematic cross-sectional view of the lighting arrangement in FIG. 1.
Figure 3:
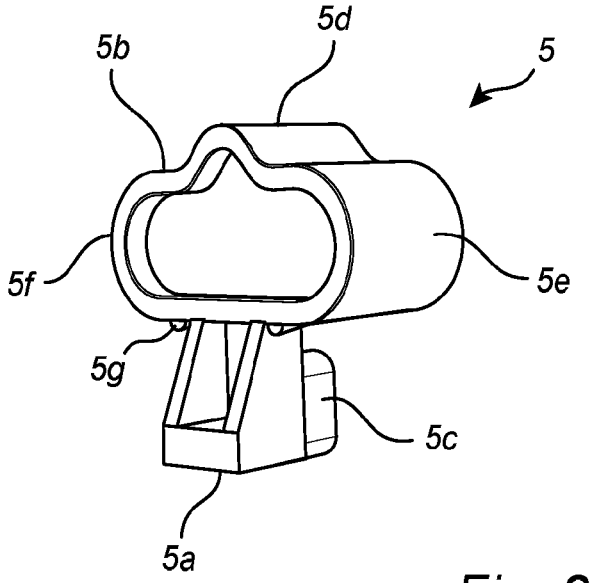
FIG. 3 is a schematic perspective view of the resilient element of the lighting arrangement in FIG. 1.

A lighting arrangement 1 in the form of a straight tube lighting system is described below with reference to FIGS. 1 to 3. A transverse cross-sectional view of the tube lighting system 1 in FIG. 1 is shown in FIG. 2. A schematic perspective view of the resilient element 5 in FIGS. 1 and 2 is shown in FIG. 3.

The extension of the tube lighting system 1 defines three perpendicular axes: a longitudinal axis L, a transverse axis T and a vertical axis V. The tube lighting system 1 comprises a circuit board 2, for example a printed circuit board. The circuit board 2 can have a planar rectangular shape with a first edge 2*a*, substantially parallel with the longitudinal axis L, and a second edge 2*b*, substantially parallel with the vertical axis V. Two opposing sides 2*c*, 2*d* of the circuit board 2 can be substantially coplanar with a plane whose surface normal is parallel with the vertical axis V. In FIGS. 1 and 2, however, the two opposing sides 2*c*, 2*d* of the circuit board 2 are substantially coplanar with a plane whose surface normal is parallel with the transverse axis T.

The circuit board 2 provides electrical circuitry for light sources 4 in the form of LEDs which can be chosen from the group consisting of semiconductor LEDs, organic LEDs and polymer LEDs. Other types of light sources 4 are conceivable, for example laser diodes. The LEDs 4 are mounted on the circuit board 2. They can be arranged in any pattern on the circuit board 2, for example as an elongated array. The LEDs 4 can be arranged a longitudinal distance d apart along a straight line which is substantially parallel with the longitudinal axis L. The longitudinal distance d can be substantially constant, or it can vary. The LEDs 4 can be arranged in a zigzag pattern, or along a slightly curved line. The LEDs 4 can be arranged to emit light in any direction, for example in a direction which is substantially parallel with the vertical direction V. The LEDs 4 can be arranged to emit light in a direction which is substantially parallel with the transverse direction T. The LEDs 4 in FIGS. 1 and 2 are arranged to emit light in two opposite directions which are substantially parallel with the transverse direction T. To this end, LEDs 4 can be mounted on both of the two opposing sides 2*c*, 2*d* of the circuit board 2 so that the LEDs 4 emit light from both sides 2*c*, 2*d* of the circuit board 2. Note that the intensity of the light emitted by an LED 4 typically is distributed around the direction in which the LED 4 is arranged to emit light. By an LED 4 being arranged to emit light in a certain direction is meant that the highest intensity of the light emitted by the LED 4 is in that direction.

The tube lighting system 1 also has at least one resilient element 5. The appropriate number of resilient elements 5 can depend on the size of the tube lighting system 1. Typically, at least two resilient elements 5 are provided. In some applications, non-conducting or low-conducting resilient elements 5, such as plastic resilient elements 5, may be advantageous. However, the resilient elements 5 can be made of a metal. The resilient element 5 can comprise an attachment portion 5*a* for attaching the resilient element 5 to the circuit board 2. The attachment portion 5*a* can for example be provided with a pin 5*c* which can be inserted into a through-hole 2*e* between the two opposing sides 2*c*, 2*d* of the circuit board 2. The construction of the resilient element 5 as shown in FIG. 3 enables that the resilient element determines the distance between the first edge 2*a* the circuit board 2 and the support 3 via the attachment portion 5*a*. The bottom side of the resilient portion 5*b* will be in contact with, or in the close vicinity of the first edge 2*a* of the circuit board 2, when the resilient element is attached to the circuit board. When inserting the light module in the tube 11 the resilient element 5 will press the circuit board 2 downwards, which movement is limited by the attachment portion 5*a* hitting the top surface of the support structure 8, The resilient element 5 can include a snap-on feature 5*g* for helping to secure the resilient element 5 to the circuit board 2. The resilient element 5 can have a resilient portion 5*b*. The resilient portion 5*b* can be cylindrical. The resilient portion 5*b* can have end portions 5*e*, 5*f* which are rounded. A cross-section of the resilient portion 5*b* can be substantially obround. A cross-section of the resilient portion 5*b* can have two rounded ends which are connected to each other at their end points by two substantially parallel lines. The resilient portion 5*b* can resiliently connect the attachment portion 5*a* to an abutment portion 5*c* adapted to slide against a surface, for example the surface of a cover 7 for transmitting light emitted by the LEDs 4. An example of such a cover 7 will be further described below. The abutment portion 5*d* can be formed by a rounded protrusion. The attachment portion 5*a*, the resilient portion 5*b* and the abutment portion 5*d* can be formed in one piece.

The resilient elements 5 are sandwiched between the circuit board 2 and an abutment 6, which is fixed relative to the support 3. The resilient elements (5) will thereby s press the circuit board (5) against the support (3). In FIG. 1, the resilient elements 5 are arranged along the longitudinal axis L. The longitudinal distance between two consecutive resilient elements 5 can vary. The abutment 6 can be arranged on an elongated cover 7 for transmitting the light emitted by the LEDs 4. The abutment 6 can be formed in one piece with the cover 7 or attached to the cover 7.

The cover 7 can be formed by transparent plastics. The cover 7 can be extruded. The cover 7 can include at least one optical element 7*a* for shaping the light that is emitted by the LEDs 4 so that the illumination produced by the tube lighting system 1 has a desired distribution. In some applications, it may be desirable that the illumination has a high intensity in the transverse direction T. Some applications may require that the intensity of the illumination is uniformly distributed in a plane whose surface normal is parallel with the longitudinal axis L. The at least one optical element 7*a* can be attached to the cover 7. The at least one optical element 7*a* can be formed in one piece with the cover 7.

The cover 7 can be supported by a support structure 8. The plane defined by the contact points or contact lines between the support structure and cover is referred to as a separating plane. The surface normal of the separating plane is typically substantially parallel with the vertical axis V. In FIGS. 1 and 2, the circuit board is substantially perpendicular to the separating plane. However, in an alternative embodiment, the circuit board 2 can be coplanar with the separating plane. The support structure 8 can be made of plastics. The support structure 8 can be extruded. The cover 7 and the support structure 8 can be formed by two separate pieces which can be attached together. Alternatively, the support structure 8 can be formed in one piece with the cover 7. If the support structure 8 and the cover 7 are formed in one piece, as in FIGS. 1 and 2, the cover 7 can be a part of that piece which is arranged to receive light from the LEDs 4 and the support structure 8 can be a part of that piece which is not arranged to receive light from the LEDs 4.

The printed circuit board 2 is supported by a support 3. The support 3 can be provided on the support structure 8, the cover 7, or both. The support 3 can be formed in one piece with the support structure 8, for example by an indentation, a recess or a protrusion in the support structure 8. The support 3 can be attached to the support structure 8. The support 8 can have an elongated shape. The support 3 can be a slot. Note that the circuit board 2 can, but does not have to, be in direct contact with the support 3.

The tube lighting system 1 can include a carrier 9 which is supported by the support 3 and on which the circuit board 2 is arranged. The carrier 9 can be an elongated profile section, for example a linear profile section. The carrier 9 can be a heat sink in thermal contact with the circuit board 2. The carrier 9 can be in direct contact with the support 3. As is shown in FIGS. 1 and 2, the circuit board 2 can be arranged on the carrier 9 so that the two opposing sides 2*c*, 2*d* of the circuit board 2 are substantially perpendicular to the separating plane, i.e. the two opposing sides 2*c*, 2*d* can be substantially coplanar with a plane whose surface normal is parallel with the transverse axis T. However, in an alternative embodiment, the circuit board 2 can be arranged on the carrier 9 so that the two opposing sides 2*c*, 2*d* of the circuit board 2 are substantially coplanar with the separating plane. Stated in another way, the two opposing sides 2*c*, 2*d* can be substantially coplanar with a plane whose surface normal is parallel with the vertical axis V.

The carrier 9 can include a reflective layer 10 for reflecting light emitted by the LEDs 4. The reflective layer 10 can be diffusely reflective or specularly reflective. A sheet or a foil, for example a metallic foil, can form the reflective layer 10. The reflective layer 10 can be planar. The reflective layer 10 can be substantially coplanar with the separating plane.

The carrier 9 can also include two recesses 9*a*, 9*b*. As is shown in FIGS. 1 and 2, the recesses 9*a*, 9*b* can be arranged on a respective side of the two opposing sides 2*c*, 2*d* of the circuit board 2. The two recesses 9*a*, 9*b* are aligned with the LEDs 4 and the reflective layer 10 so that a portion of the reflective layer 10 is arranged between the two recesses 9*a*, 9*b* and the LEDs 4 as seen along the vertical axis V. The recesses 9*a*, 9*b* face the reflective layer 10 so that a portion of the reflective layer 10 is received by the two recesses 9*a*, 9*b* when the LEDs 4 are pressed against the reflective layer 10 as a result of the resilient element 5 pressing against the circuit board 2.

The cover 7 and the support structure 8 can be integrated to form an elongated tube 11 adapted to receive the circuit board 2. The tube 11 can be straight. The cover 7 and the support structure 8 can be formed in one piece having the shape of an elongated tube 11. Alternatively, the cover 7 and the support structure 8 can be attached to each other so as to form the tube 11. The circuit board 2, with the resilient elements 5, and the carrier 9 can be inserted into the tube 11 in a direction I which is substantially parallel with the longitudinal axis L. The resilient elements 5 can help guide the circuit board 2 into the tube 11 during insertion.

Figure 4:
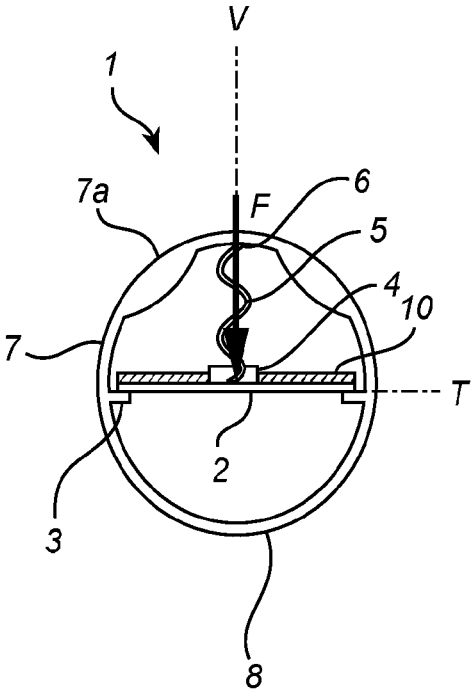
FIG. 4 is a schematic cross-sectional view of a tube lighting arrangement with the abutment arranged on the cover.

The lighting arrangement 1 in FIG. 4 is similar to that in FIG. 1. However, the lighting arrangement in FIG. 4 has no carrier 9 and the circuit board 2 is substantially coplanar with the separating plane, i.e. the circuit board 2 is substantially coplanar with a plane whose surface normal is parallel with the vertical axis V. The resilient element 5 presses the circuit board 2 directly against the support 3 which is fixed relative to the abutment 6. The abutment 6 is arranged on the cover 7.

Figure 5:
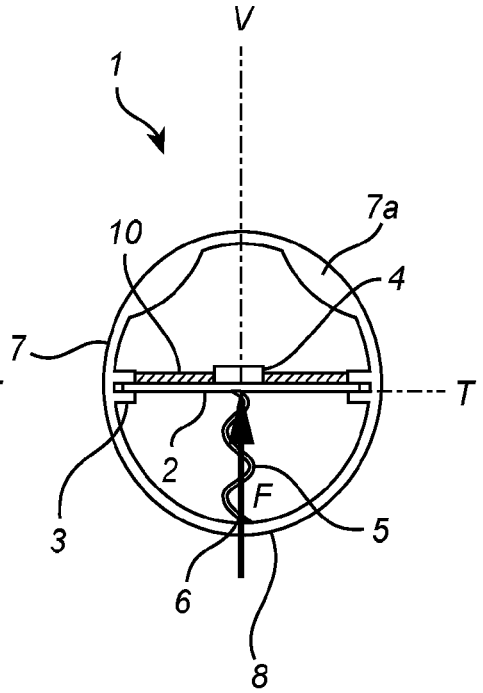
FIG. 5 is a schematic cross-sectional view of a tube lighting arrangement with the abutment arranged on the support structure.

The lighting arrangement in FIG. 5 is similar to that in FIG. 4. However, in FIG. 5, the abutment 6 is arranged on the support structure 8. The support 3 is formed by two transversely opposing slots in the support structure 8.

When the lighting arrangement 1 is in an assembled configuration, the resilient element 5 is sandwiched between the at least one abutment 6 and the circuit board 2. Hence, the at least one resilient element 5 presses against the circuit board 2 so that a force F having a component in the vertical direction V is imparted on the circuit board 2. The force F presses the circuit board 2 against the support 3, or against a carrier 9 which then is pressed against the support 3, thereby helping to prevent displacement of the LEDs 4.

The person skilled in the art realizes that the present invention by no means is limited to the preferred embodiments described above. On the contrary, many modifications and variations are possible within the scope of the appended claims. For example, the tube lighting system 1 does not have to be straight. The tube lighting system 1 can be curved. The tube lighting system 1 can have the shape of a torus. If the cover 7 and the support 8 are separate pieces, the circuit board 2, the resilient elements 5 and the carrier 9 can be arranged inside the tube 11 by having the cover 7 and the support structure 8 enclosing them before attachment. This can be a convenient way of assembling a curved tube lighting system 1.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A lighting arrangement, comprising a circuit board, a support for supporting the circuit board and at least one light source mounted on the circuit board, a cover for transmitting light emitted by the at least one light source, a support structure for supporting the cover in a separating plane, wherein the support is provided on the support structure, wherein at least one abutment which is arranged on the cover and fixed relative to the support and at least one resilient element which is sandwiched between the at least one abutment and the circuit board, whereby the circuit board is pressed against the support by the resilient element, said lighting arrangement further comprising a carrier supported by the support wherein the circuit board is arranged on the carrier.

2. The lighting arrangement according to claim 1, wherein the cover comprises at least one optical element for shaping the light transmitted by the cover.

3. The lighting arrangement according to claim 1, wherein the circuit board has a planar extension substantially perpendicular to the separating plane.

4. The lighting arrangement according to claim 3, further comprising at least one light source mounted on each of two opposing sides of the circuit board.

5. The lighting arrangement according to claim 4, wherein the carrier comprises a reflective layer for reflecting light emitted by the at least one light source and two recesses facing the reflective layer so that the reflective layer is received by the two recesses when the at least one resilient element presses against the circuit board.

6. The lighting arrangement according to claim 1, wherein the carrier is a heat sink in thermal contact with the circuit board.

7. The lighting arrangement according to claim 1, wherein the circuit board has a planar extension substantially coplanar with the separating plane.

8. The lighting arrangement according to claim 1, wherein the at least one resilient element comprises an attachment portion for attachment to the circuit board, an abutment portion adapted to slide against a surface and a resilient portion which resiliently connects the attachment portion to the abutment portion.

9. The lighting arrangement according to claim 8, wherein resilient element is arranged to determine the distance between a first edge of the circuit board and the support via the attachment portion.

10. The lighting arrangement according to claim 1, comprising an elongated array of light sources.

11. The lighting arrangement according to claim 10, wherein the cover and support structure are integrated to form an elongated tube adapted to receive the circuit board by insertion.

* * * * *